United States Patent [19]

Rasimus

[11] Patent Number: 4,541,220

[45] Date of Patent: Sep. 17, 1985

[54] EDGE FOLDER

[76] Inventor: Seppo U. Rasimus, Vasamankatu 12, 57200 Savonlinna 20, Finland

[21] Appl. No.: 499,145

[22] PCT Filed: Oct. 12, 1982

[86] PCT No.: PCT/FI82/00043

§ 371 Date: May 25, 1983

§ 102(e) Date: May 25, 1983

[87] PCT Pub. No.: WO83/01429

PCT Pub. Date: Apr. 28, 1983

[30] Foreign Application Priority Data

Oct. 14, 1981 [FI] Finland ..... 813193

[51] Int. Cl.[4] ..... B65B 11/04; B65B 49/14; B31B 1/28

[52] U.S. Cl. ..... 53/380; 53/211; 493/157; 493/308

[58] Field of Search ..... 493/157, 159, 156, 308; 53/380, 211, 378

[56] References Cited

U.S. PATENT DOCUMENTS 2,938,319 5/1960 Nystrand ..... 53/380
3,315,432 4/1967 Turnbull et al. ..... 53/380
3,533,332 10/1970 Young et al. ..... 493/157
3,605,382 9/1971 Andersson ..... 53/380

FOREIGN PATENT DOCUMENTS 2313268 12/1976 France ..... 53/380

*Primary Examiner*—Daniel C. Crane
*Attorney, Agent, or Firm*—Kuhn Muller and Bazerman

[57] ABSTRACT

A device for folding the edge of a wrapping material wound around a roll against the end of the roll. The device comprises an endless rotating means, such as a chain or a belt, at least one wheel member around which the rotating means is arranged to rotate. Pressing means pivotably attached to the endless rotating means for pressing said edge against the end of the roll when the rotating means is rotated from the circumference of the roll towards the center thereof, and driving means for driving the rotating means characterized in that the pressing means to the rotating means are such that the pressing means when in contact with the end of the roll pivot about an axis parallel with the axis of rotation of the roll (7) to an angle determined by the circumferential velocity of the roll (7) and the speed of movement of the rotating means (1).

6 Claims, 3 Drawing Figures

EDGE FOLDER

The present invention concerns a device which is used, when a cylindrical object, particularly a roll of paper, is being packed, for folding the edge of the wrapping wound around the object against the end of the object. In the present invention, the said device is called edge folder.

When paper rolls are being packed, a wrapping paper whose width is larger than the length of the roll to be packed is most usually used as mantle wrapping, such that the edges of the wrapping paper extend beyond the ends of the roll. This is in order that the edges of the wrapping paper can be folded against the ends of the roll, and circular end plates corresponding to the diameter of the roll are placed against the folds and usually glued thereon. Hereby the package formed by the wrapping paper and by the end plates becomes closed, thereby protecting the roll during handling and transportation.

The folding of the edges of the wrapping paper takes place either manually or mechanically. A drawback of manual work is that the work is hard, expecially when thick wrapping paper is used as several layers. Moreover, folding made by hand remains loose, because manually the wrapping cannot be pressed very tightly against the ends of the roll. On the other hand, loose folding allows such portions to remain in the finished package as are torn during the various stages of handling, thereby causing damage to the roll, with resulting rejection.

In view of elimination of these drawbacks, there are various methods and devices for mechanized folding of the edges of wrapping paper. As such a device, a device is commonly used in which, from the top and from the side of the roll, a wheel is brought into contact with the end of the roll which, while revolving simultaneously with the roll, causes folding of the edges of the wrapping paper against the end. It is a drawback of such a device, among other things, that, in order that the device should work, it requires transfer means for both vertical and horizontal movement within the range of variation of the diameters and lengths of all the rolls to be packed. Moreover, the device must have separate sensing means for controlling the movement in the horizontal direction and in the vertical direction in order that the device could operate automatically and efficiently within the range of variation of all of the rolls to be packed. The constructions required by such movements in different directions are complicated and, in order to be able to operate, require a rather large space, for which reason the devices become expensive to construct and difficult to install, e.g., in existing packaging plants, in which usually no space has been provided for them.

In the device described above, the wheel forming the fold glides against the end of the roll and, when gliding, rubs both against the wrapping paper and against and end sheet placed against the end of the roll and remaining underneath the folding. This requires, among other things, that the wrapping paper must be sufficiently strong in order to stand said rubbing and that the width of the wrapping paper in excess of the roll length is appropriate, and not excessive, which excessive length causes incomplete folding, nor insufficient, which would again cause difficulties, for example, for the end sheet to remain underneath the folding during the folding operation. Owing to the above circumstances, it is prerequisite for reliable operation of the device that the quality and the width of the wrapping paper are exactly predetermined, which again causes additional requirements and additional costs in the acquisition of wrapping papers.

Another device that is commonly used is described in the Finnish Pat. No. 45,536, wherein the members used for folding the edge of the wrapping paper are placed between the rollers rotating the roll so that the device comprises a separate wheel, to which the wings forming the folds have been attached, as well as a separate pressing device, by means of which the folds produced are pressed against the end of the roll. The space requirement of such a device is little, which is an advantage as compared with the device discussed above. The device, however, comprises separate members for forming the fold and for pressing it, and therefore it is rather complicated. In this device as well, the wings that form the folds glide along the wrapping and cause rubbing against same, whereby the wrapping paper must be of an appropriate quality, e.g., sufficiently strong, so that the final result should be satisfactory. Moreover, the excess width of the wrapping, passing beyond the end of the roll, may vary within rather narrow limits without causing disadvantage.

The object of the present invention is to eliminate the drawbacks related to the above prior art constructions and to create a more efficient and reliable edge folder.

The edge folder in accordance with the present invention usually comprises two separately operating units, one at each side of the roll. The units are most commonly placed in connection with the rollers on which the roll is rotating, usually between these rollers, and they are movable in the axial direction of the roll by means of an operating cylinder or of any other drive unit. Each unit is provided with an endless chain or belt, which runs around idle wheels placed one after the other so that, at the side facing the end of the roll, the direction of movement of the chain or belt is from the the circumference of the roll towards the centre. Pressing means are attached to the chain or belt, which pressing means, during operation of the unit, reach contact with the edge of the wrapping paper passing beyond the end of the roll and press said edge against the end of the roll, whereby the edges of the wrapping paper are folded against the end of the roll.

By using rolls as pressing means, which rolls are attached to the chain or belt by means of articulated joints so that the rolls may pivot to assume the relative direction of movement formed by the circumferential velocity of the roll and by the speed of movement of the chain, the folding takes place by rolling the edge of the wrapping paper against the end of the roll, and hereby the drawbacks resulting from the rubbing mentioned above are avoided.

By means of the edge folder in accordance with the invention, the contact distance between the pressing means and the end of the roll can also be made sufficiently long, and in this way it is, if necessary, possible to use a more abundant wrapping width than in the devices described above, without producing any distrubances of operation: the wrapping paper being folded incompletely or the paper being torn. In this way, the selection of wrapping papers of different widths in use may be reduced and a wrapping material of lower strength and also of lower cost may be used. This often permits the use of paper and cardboard rejected from production, instead of special wrapping papers acquired from other sources, which is a remarkable economical and technical advantage in the production.

Below, the construction and operation of the device in accordance with the invention will be described in more detail with reference to the attached drawings and to their details.

Figure 3:
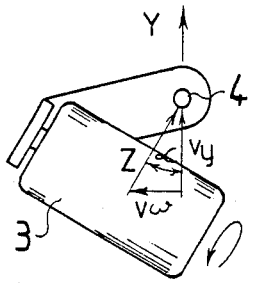
FIG. 3 shows the positioning of the pressing means in relation to the end of the roll.
Figure 1:
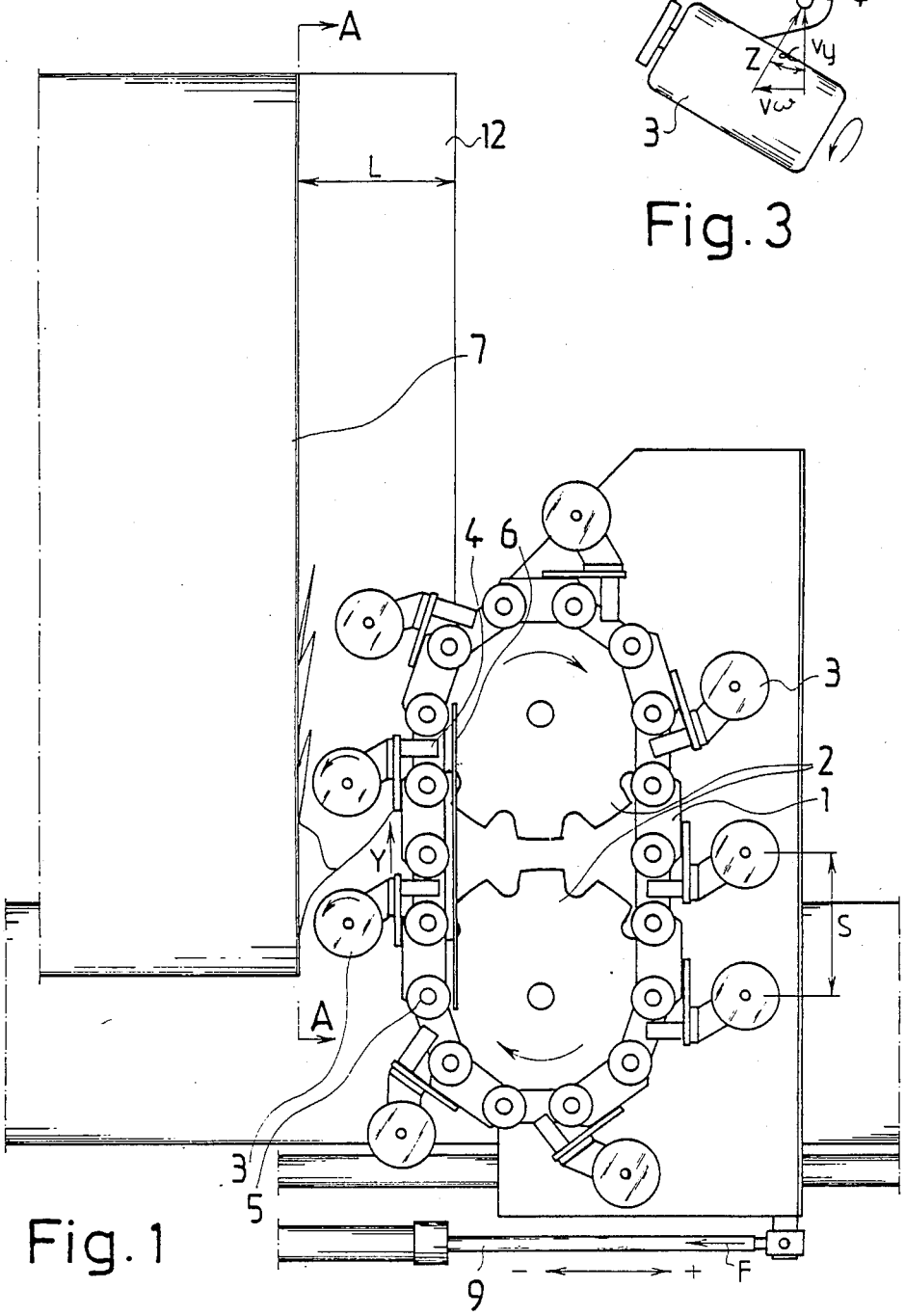
FIG. 1 shows one embodiment of the edge folder in accordance with the inventions as a side view.

The endless chain (or belt) 1 runs around idle wheels 2. Pressing rolls 3 are attached to the chain 1 by means of articulated joints 4. Running rolls 5 provided in the chain lie against the base 6 when the pressing rolls 3 are in contact with the end of the paper roll 7. The endless chain is driven by a drive gear 8 mounted on the shaft of the upper idler wheel 2. The device is shifted in the lateral direction by an operating cylinder 9 along guide shafts 10. The rotating of the paper roll 7 takes place by means of rotating rollers 11.

Figure 2:
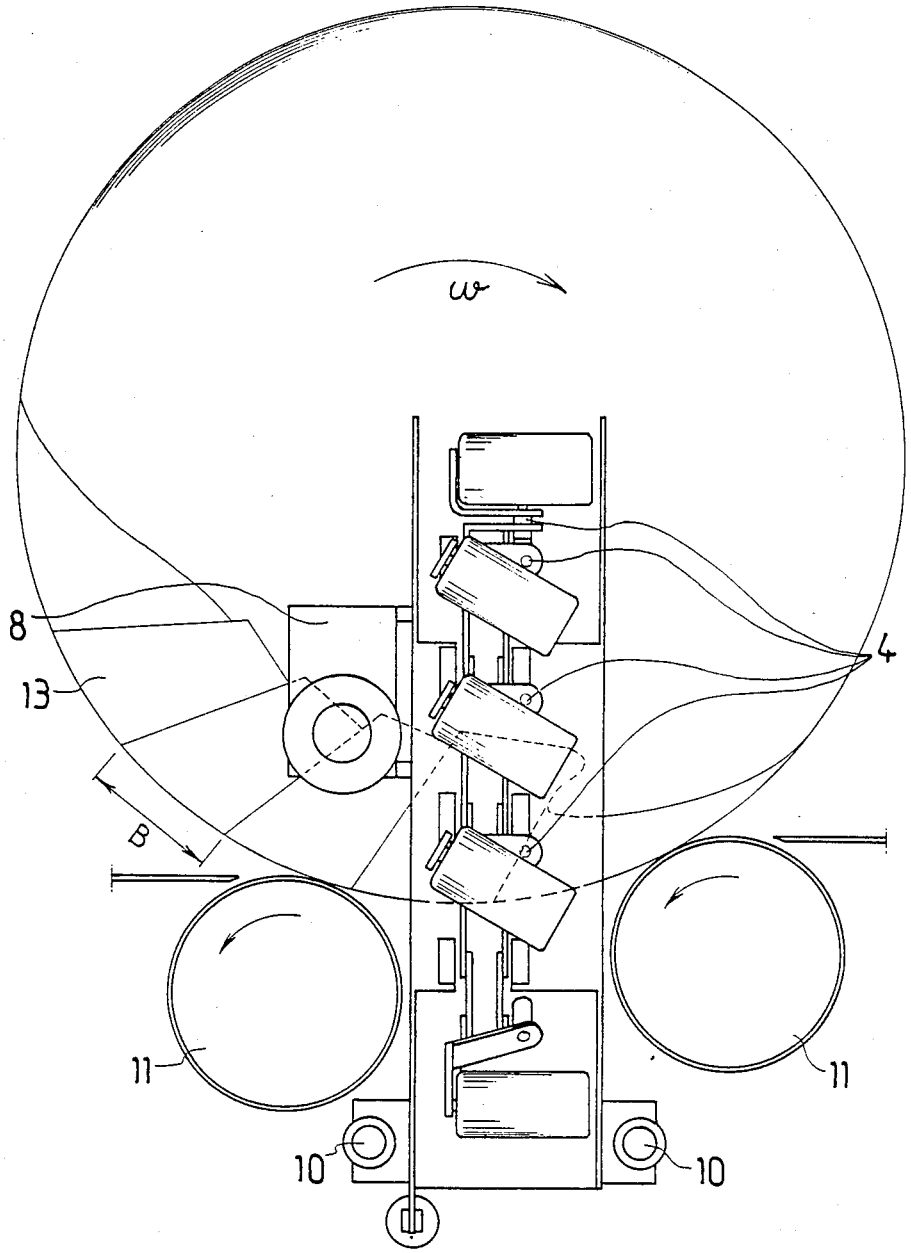
FIG. 2 shows a front view of the folder of FIG. 1, taken along line A—A.

The wrapping paper 12 wound around the roll 7 extends beyond the end of the roll 7 by the width L. The end folder approaches the end of the roll as driven by the cylinder 9 in the direction "—", at the same time as the roll 7 revolves in the direction $\omega$ and the chain moves in the direction Y. When the pressing rolls 3 meet the edge 12 of the wrapping paper, they press it towards the end 7, and when the pressing rolls 3 meet the end of the roll 7, the movement of the cylinder 9 stops and the end folder presses the pressing rolls 3 against the roll end by means of a force corresponding to the cylinder force F. Thereby, when the roll 7 revolves and the pressing rolls 33 press the edges 12 of the wrapping paper against the end of the roll 7, folds 13 are formed in the way indicated by FIG. 2. The width B of the folds 13 depends on the speed of rotation $\omega$ of the roll, on the speed of movement Vy of the chain 1, and on the distance S between the pressing rolls 3. Those factors are adjusted in relation to each other so that the width B of the folds is suitable.

FIG. 3 illustrates the way in which a pressing roll 3 pivots around its articulated joint 4. In the figures, $V\omega$ denotes the circumferential velocity of the roll 7 at the point of contact with the pressing roll 3. Vy denotes the speed of movement of the chain 1, and Z denotes the relative direction of movement of the pressing roll 3 in relation to the roll end 7. Here, the pressing roll 3 assumes an angle $\alpha$ in relation to the running direction Y of the chain 1, and the movement of the pressing roll 3 in relation to the roll end 7 is a rolling movement.

As comes out from the above description, the edge folder in accordance with the invention is advantageous in construction and use, and by means thereof the advantages described above are achieved, as compared with the other prior art devices used for a corresponding purpose.

The device described above is just one embodiment, and it is evident that, in accordance with the principle of operation and construction, the device may be constructed in different ways. There may, e.g., be several chains or belts and the device may also be placed elsewhere, except between the rotating rollers 11, e.g., outside the rollers ore above the roll 7. In the drawings, rolls 3 are shown as pressing means, but the pressing means may also be, e.g., stationary or mobile plate-like pressing means, and thereby they are also included in the scope of the present invention. The pressing rolls may have a uniform or a divided structure.

What is claimed is:

1. A device for folding the edge (12) of a wrapping material wound around a roll (7) against the end of the roll (7), comprising:

means for supporting said wrapped roll so that the roll axis extends in a predetermined direction;

and, a folding means mounted adjacent said roll supporting means so that said folding means is in folding position to an end of said wrapped roll, said folding means comprising:

an endless rotating means (1), such as a chain or a belt, at least one wheel member (2) around which the rotating means (1) is arranged to rotate and for moving the endless rotating means from the circumference of the rod (7) towards the roll axis at the centre thereof, pressing means (3) pivotably attached to the endless rotating means (1) for pressing said edge (12) into contact against the end of the roll (7) when the rotating means (1) is rotated from the circumference of the roll (7) towards the centre thereof, and driving means (8) for driving the rotating means characterized in that the pressing means (3) pivoted to the rotating means (1) are such that the pressing means (3) when pressing the edge (12) in contact with the end of the roll (7), pivot about an axis parallel with the axis of rotation of the roll (7) to an angle determined by the circumferential velocity of the roll (7) and the speed of movement of the rotating means (1).

2. A device according to claim 1, characterized in that each pressing means comprises a pressing roll (3) rotatively and pivotably attached to the rotating means (1).

3. A device according to claim 2, characterized in that each pressing roll (3) is cylindrical.

4. A device according to claim 2, characterized in that each pressing roll (3) has a uniform structure.

5. A device according to claim 1, wherein the endless rotating means comprises an endless chain (1) with running rolls (5), characterized by a base (6) arranged in parallel relationship with the chain (1) at the pressure contact side thereof for supporting the running rolls (5) during the passage of the endless chain (1) between said base (6) and the end of the roll (1).

6. A device according to claim 1 characterized in that the at least one of the wheel members (2) is driven by the driving means (8).

* * * * *